US011465009B2

(12) United States Patent
Larm et al.

(10) Patent No.: US 11,465,009 B2
(45) Date of Patent: Oct. 11, 2022

(54) KETTLEBELL SYSTEM

(71) Applicants: Mark E. Larm, Alpine, CA (US); Annalisa Larm, Alpine, CA (US)

(72) Inventors: Mark E. Larm, Alpine, CA (US); Annalisa Larm, Alpine, CA (US)

( * ) Notice: Subject to any disclaimer, the term of this patent is extended or adjusted under 35 U.S.C. 154(b) by 0 days.

(21) Appl. No.: 17/022,838

(22) Filed: Sep. 16, 2020

(65) Prior Publication Data

US 2022/0080251 A1 Mar. 17, 2022

(51) Int. Cl.

| | |
|---|---|
| ***A63B 21/072*** | (2006.01) |
| ***A63B 21/00*** | (2006.01) |
| ***A63B 21/075*** | (2006.01) |
| ***A63B 21/06*** | (2006.01) |

(52) U.S. Cl.

CPC ..... *A63B 21/0728* (2013.01); *A63B 21/0607* (2013.01); *A63B 21/075* (2013.01); *A63B 21/4035* (2015.10)

(58) Field of Classification Search

CPC ..... A63B 21/0728; A63B 21/0607; A63B 21/075; A63B 21/4035; A63B 22/20; A63B 21/00061; A63B 21/0442; A63B 21/0552; A63B 21/4015; A63B 21/4034; A63B 21/4043; A63B 23/03541; A63B 23/1236; A63B 21/4049; A63B 2208/0295; A63B 21/0004; A63B 21/00058–00065; A63B 21/00185; A63B 21/06–0607; A63B 21/072–075; A63B 21/4023; A63B 21/4033; A63B 23/1209; A63B 23/1227; A63B 26/003

See application file for complete search history.

(56) References Cited

U.S. PATENT DOCUMENTS

| | | | | |
|---|---|---|---|---|
| 7,563,208 | B1 * | 7/2009 | Chen | A63B 21/0728 482/108 |
| 8,002,678 | B1 * | 8/2011 | Krull | A63B 21/0728 482/93 |
| 10,463,906 | B2 * | 11/2019 | Owusu | A63B 21/00065 |
| 11,130,014 | B2 * | 9/2021 | Sisler | A63B 21/075 |
| 2011/0028285 | A1 * | 2/2011 | Towley, III | A63B 21/0728 482/108 |
| 2012/0231936 | A1 * | 9/2012 | Krull | A63B 21/072 482/93 |
| 2013/0040789 | A1 * | 2/2013 | Kessler | A63B 21/072 482/108 |
| 2015/0105224 | A1 * | 4/2015 | Odneal | A63B 21/0722 482/107 |
| 2017/0225025 | A1 * | 8/2017 | Towley | A63B 21/075 |
| 2021/0023411 | A1 * | 1/2021 | Wang | A63B 21/075 |
| 2021/0178217 | A1 * | 6/2021 | Ix | A63B 21/4035 |
| 2021/0379440 | A1 * | 12/2021 | Sisler | A63B 21/0728 |

* cited by examiner

*Primary Examiner* — Joshua Lee
*Assistant Examiner* — Catrina A Letterman
(74) *Attorney, Agent, or Firm* — Donn K. Harms

(57) ABSTRACT

A kettlebell having a planar body. The kettlebell has a curved handle with an arched central portion connected to the body for gripping. A first edge and opposing second edge of the body positioned between two outward curved edges are linear and substantially parallel to form the body of the kettlebell with two opposing straight sides.

8 Claims, 6 Drawing Sheets

KETTLEBELL SYSTEM

BACKGROUND OF THE INVENTION

1. Field of the Invention

The invention herein disclosed relates generally to a hand-held exercise device and system. More particularly, it relates to a kettlebell exercise device which is configured for both conventional kettlebell exercises as well as employment for exercise with a planar surface of the disclosed kettlebell herein positioned on a support surface.

2. Prior Art

Background of the Invention

In recent years kettlebells have become a popular component in exercise regimens. A kettlebell is conventionally formed of cast iron or cast steel and has a ball shape with a handle extending from the top of the ball which provides weight for exercising. The kettlebell is popular for performing many types of exercises, including ballistic exercises that combine cardiovascular, strength and flexibility training.

While somewhat similar to dumbbells, which are also used for exercise, the center of the mass of a kettlebell, is extended beyond the hand of the user gripping the handle. So configured with the extending handle, a kettlebell allows different exercises than that of a hand-held dumbbell, such as those employing swing movements of the kettlebell. Such swing movements, while gripping the extended handle, provide added safety during use for grip, wrist, arm and core strengthening. Due to its configuration, unlike a dumbbell, the weight of a kettlebell is fixed, but is unevenly distributed. As a consequence, a gripped kettlebell which is swung or otherwise moved by the user gripping it, provides a changing or unstable force the user must resist during such movement. Such is a desirable aspect for users for the effectiveness of the kettlebell exercises.

With respect to the above, before explaining at least one preferred embodiment of the kettlebell system herein, it is to be understood that the system invention is not limited in its application to the details of employment and to the arrangement of the components or the steps set forth in the following description or illustrated in the drawings. The various components and configurations herein disclosed for the kettlebell system are capable of other embodiments, and of being practiced and carried out in various ways, all of which will be obvious to those skilled in the art once the information herein is reviewed.

Also, it is to be understood that the phraseology and terminology employed herein are for the purpose of description and should not be regarded as limiting. As such, those skilled in the art will appreciate that the conception upon which this disclosure is based, may readily be utilized as a basis for other kettlebell systems. It is important, therefore, that the embodiments, objects and claims herein, be regarded as including such equivalent construction and methodology insofar as they do not depart from the spirit and scope of the present invention.

SUMMARY OF THE INVENTION

In this summary description, any directional prepositions if employed, such as up, upwardly, down, downwardly, front, back, top, upper, bottom, lower, left, right and other such terms refer to the device or depictions as they may be oriented are for convenience only in describing such as it appears in the drawings. Such terms of direction and location are not intended to be limiting in any fashion, or to imply that the device or method herein has to be used or positioned with graphics in any particular orientation. Further, if not otherwise respectively defined, by the term substantially is meant, plus or minus five percent.

The disclosed device herein provides for an exercise system using the kettlebell device herein disclosed, which employs a planar body portion which provides the primary mass or weight of the device during use. By planar body is meant that the body is planar somewhat like a pancake and has at least the bottom surface being substantially flat so it will not rock when placed on a flat support surface. A handle configured for gripping by a user during exercise extends from an upper surface of the body. A lower surface of the body opposite the upper surface, is substantially planar and configured for positioning on a planar support surface without rocking.

The handle extending from the upper surface of the body is configured for gripping by a user during a swinging of the body. Additionally, with the body lower surface positioned on a support surface, the handle may be gripped by the user for other exercises. For example, where a pair of the kettlebell devices are employed for exercise, the user may grip central portions of the handles extending from the body having a planar surface positioned on a floor and can perform pushup type exercises. This provides for a very stable positioning of the user during such exercises.

Significant enhanced stability when using a pair of the kettlebell devices herein is provided by the handle configuration. The elongated handle is connected to the top surface of the body of the device at each of two ends thereof. A central portion of the handle is arched to provide an enhanced grip area for the user. It was found in experimentation that while a straight center portion provided a good grip, an arch shape of the central portion of the handle provided users a much more comfortable grip for using the device.

The body of the device is formed with two substantially parallel linear edges positioned on opposite ends of the body. The linear edges preferably both run along a line which is substantially normal to or perpendicular to a handle axis of the handle running through the central portion thereof. By substantially is meant within five degrees of perpendicular.

The opposing straight or linear side edges on opposite ends of the body of the device, during experimentation, (as opposed to forming a circle by extension of the curve of the side edges) significantly reduced contact of the side of the body with the legs and other portions of the body of the user who swings the kettlebell device herein during exercise. While the device performs well without the linear side edges, and thus the planar body having a circular circumference will provide the unstable weight for exercise desired of a kettlebell, the opposing linear side edges are most preferred as they reduce the chance of contact with the user during use, which at best can cause discomfort on impact and more significantly, can cause bruises or impact cuts.

Additionally, from the arched central portion of the handle, curved portions extend to engagement ends of the handle which are connected to the body of the device. The total length of the handle between the exterior surface of the curved portions thereof, along the axis of the central portion, is configured such that the exterior surfaces of both of the curved portions, do not extend past an imaginary line extending above and parallel to the linear portions. The positioning of the outside surfaces of both curved portions, within the overhead footprint of the top surface of the body, also helps prevent body contact with the user during swinging exercises.

A connection axis of both ends of the handle, running from the curved portions to the top surface of the body, is vectored at an inward angle, away from the side edges of the body and toward a central area of the body. When the user employs two of the kettlebell devices herein for stationary exercises, such as by gripping two handles and performing pushup exercises, experimentation has shown that this angle or vector for force, makes for a much more stable mount, than if the connection axis is perpendicular to the top surface of the body or the support surface. Currently, an angle between 30-50 degrees works well as the angle of the axis and thus the force vector.

Additionally preferred, in all modes of the kettlebell device and system herein, is the inclusion of tapered or beveled edges central edges of the planar body of the kettlebell device. If the device is formed with a circular body, the beveled edges will run the entire circumference of the body. If the body is formed with opposing linear sided edges, which as noted is preferred, the beveled or slanted edges run on opposing central edges of the body in between the linear side edges.

These slanted or beveled side edges provide clearance for the opposing sides of the body of the device, when swinging it close to the body of the user, and has been found in experimentation to help prevent impacts. Further, these beveled edges are especially well configured for holding the engagement of polymeric covers to the body of the device.

In another preferred mode of the device herein, removably engageable secondary weights may be engaged. While the body of the device has a fixed weight amount, by attaching a secondary weight to the body, the aggregate weight for exercise may be increased.

In an additional mode of the device herein, polymeric covers can be engaged over the body of the kettlebell. The polymeric covers provide additional padding for an unlikely contact with the person of the user and prevent slipping of the kettlebells when they are used for exercise while positioned on a support surface such as a floor.

With respect to the above description, before explaining at least one preferred embodiment of the kettlebell system herein, it is to be understood that the invention is not limited in its application to the details of operation nor the arrangement of the components or the steps set forth in the following description or illustrations in the drawings. The various methods of implementation and operation of the kettlebell device and system herein are capable of other embodiments and of being practiced and carried out in various ways which will be obvious to those skilled in the art once they review this disclosure. Also, it is to be understood that the phraseology and terminology employed herein are for the purpose of description and should not be regarded as limiting.

Therefore, those skilled in the art will appreciate that the conception upon which this disclosure is based may readily be utilized as a basis for designing of other kettlebell devices and systems for carrying out the several purposes of the disclosed kettlebell system herein. Therefore, that the objects and claims herein should be regarded as including such equivalent construction, steps, and methodology insofar as they do not depart from the spirit and scope of the present invention.

It is an object of this invention to provide a kettlebell system which is safer to use for swing exercises and more comfortable for the user to grip.

It is a further object of this invention to provide a kettlebell system which is configured for the addition of weight and for positioning on a support surface where the handles may be employed for other exercises.

These together with other objects and advantages, which become subsequently apparent reside in the details of the construction and operation of the kettlebell system herein as more fully hereinafter described and claimed, reference being had to the accompanying drawings forming a part thereof, wherein like numerals refer to like parts throughout.

Further objectives of this invention will be ascertained by those skilled in the art as brought out in the following part of the specification wherein detailed description is for the purpose of fully disclosing the kettlebell exercise device and system without placing limitations thereon.

BRIEF DESCRIPTION OF DRAWING FIGURE

The accompanying drawings, which are incorporated herein and form a part of the specification, illustrate some, but not the only or exclusive, examples of embodiments and/or features. It is intended that the embodiments and figures disclosed herein are to be considered illustrative rather than limiting.

DETAILED DESCRIPTION OF THE PREFERRED EMBODIMENTS OF THE INVENTION

Figure 1:
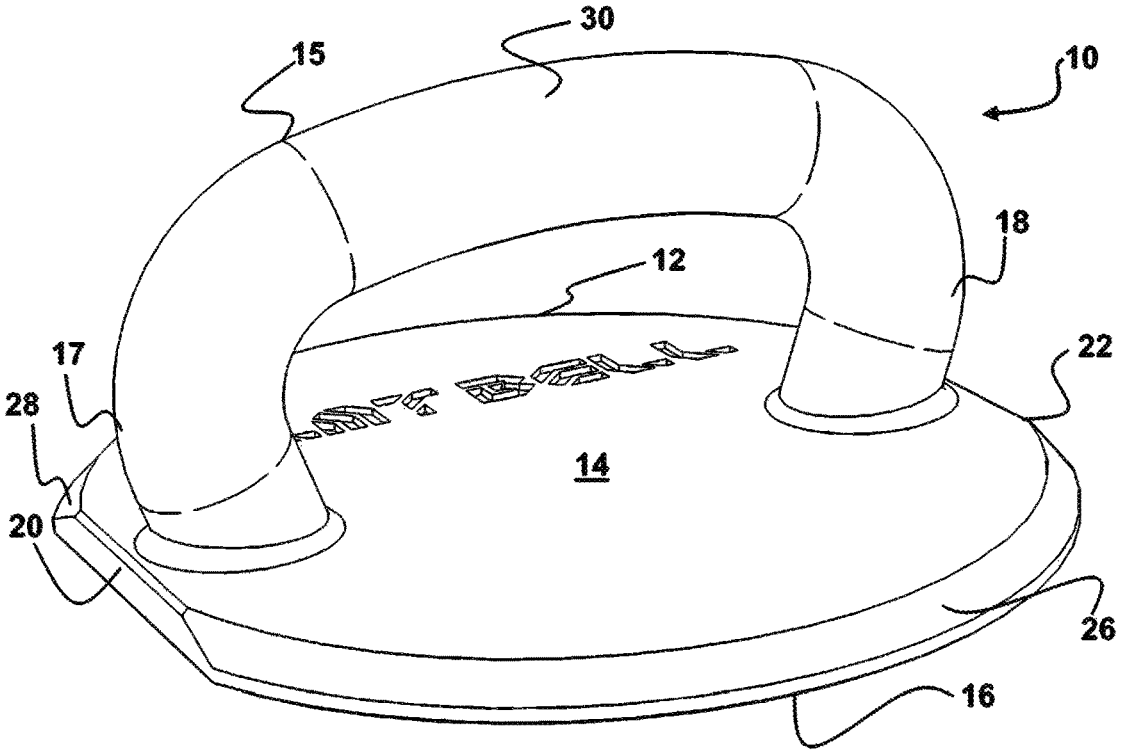
FIG. 1 depicts a perspective view of a kettlebell of the system herein showing the planar body and the handle having an arched central portion.

In this detailed description, the directional prepositions of up, upwardly, down, downwardly, front, back, top, upper, bottom, lower, left, right and other such terms refer to the device as it is oriented and appears in the drawings and are used for convenience only. Any such terms are not intended to be limiting or to imply that the device has to be used or positioned in any particular orientation.

Now referring to drawings in FIGS. 1-9, wherein similar components are identified by like reference numerals, there is seen in FIG. 1 a perspective view of a kettlebell device 10. As shown, the device 10 includes a substantially planar body 12 having an upper surface 14 opposite a lower surface 16. In all modes of the device 10, the body 12 is preferably formed as a solid or unitary structure in that during use the handle 15 in some exercises, the body 12 must support the weight of the user doing pushups or the like. Further, it is preferred the handle 15 and body 12 be formed in a unitary structure such as by molding or permanent welding of the handle 15 to a solid core body 12. As shown, the body 12 is planar and while the upper surface 14 need not be flat, and could have curve or rise to it, the lower surface 16 should be planar or flat because it is configured for positioning upon a flat or planar support surface such as a floor or mat. The U-shaped handle 15, as shown, has a first end 17 and a second end 18 engaged to the upper surface 14 of the body 12.

Figure 3:
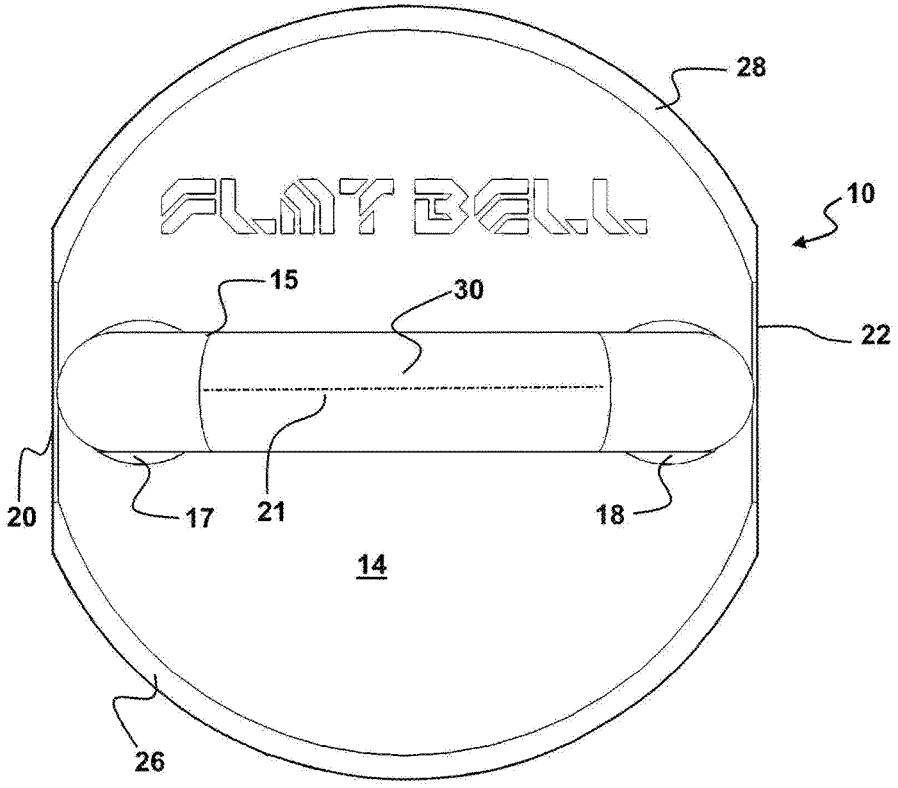
FIG. 3 is a top plan view of the device of FIGS. 1-2.

As can be seen in FIG. 1, and better in the overhead view of FIG. 3, a first side edge 20 of the body 12, located adjacent the first end 17 of the handle 15, is linear and is positioned opposite a second side edge 22 of the body 12, which is also linear. By linear is meant running in a straight line. As shown, the first side edge 20 runs parallel to the second side edge 22. Further in a preferred mode of the device 10, the first side edge 20 and second side edge 22 run substantially normal or perpendicular to a handle axis 21, which as shown in FIG. 3, runs through a central portion 30 of the handle 15.

Figure 2:
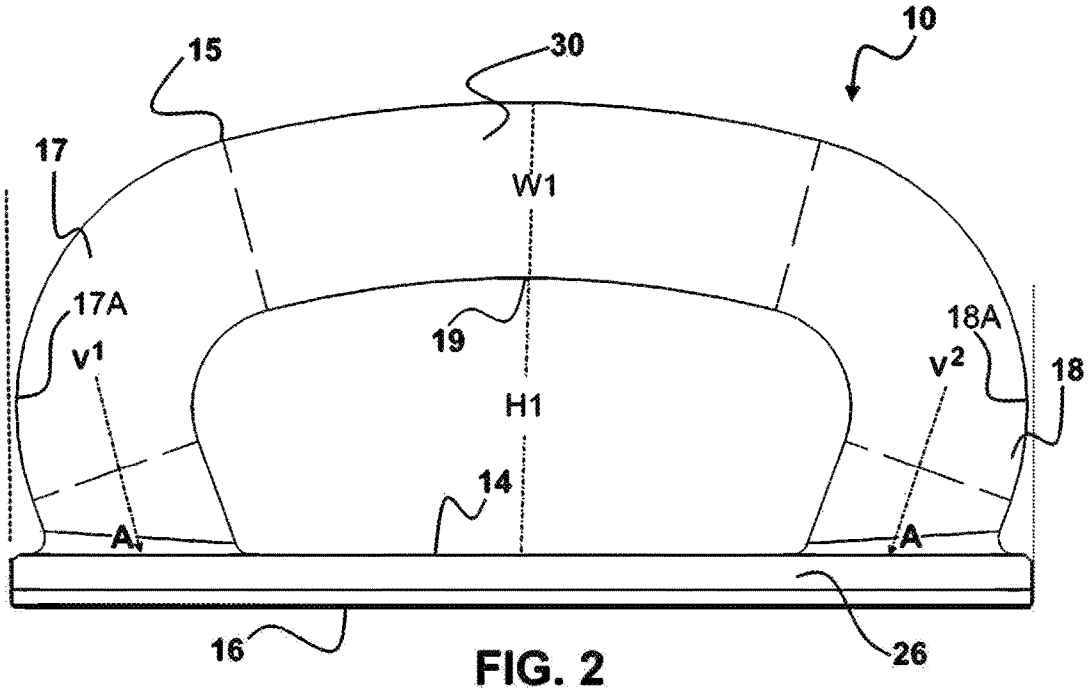
FIG. 2 shows a side view of the device as in FIG. 1, and showing the central portion of the handle shaped in an arch configuration and having opposing curved portions of the handle formed to vector force toward a center area of the planar body.

As also shown in FIGS. 1-3, a first central edge 26, and an opposing second central edge 28 of the body 12, running in between the first side edge 20 and second side edge 22, are formed as beveled edges. By beveled is meant that surfaces of the first central edge 26 and second central edge 28 run from the upper surface 14 toward the lower surface 16 at an angle between substantially 30-50 degrees. As noted, this beveled edge shape is preferred as it helps prevent contact of the sides of the body 12 against the user during exercise and renders any contact of the body 12 with the edge supported on the outer forearm of the user while gripping the handle 15, more comfortable.

As shown in the side view of FIG. 2, the handle 15 of the device 10 has a central portion 30 shaped in an arch configuration. While a linear central portion 30 was found to work well in testing, forming the central portion 30 with a curved or arch shape, was found to be much more comfortable for the user to grip the device 10 during use for swinging and for the comfort of the user where the handles 15 are gripped to support the weight of the user. As such, an arch or curve shape of the central portion 30 of the handle is preferred.

Also shown in FIG. 2 is a diameter of the central portion 30, which determines an exterior circumference area thereof, and the area for gripping for a user. Currently, a diameter between 1-2 inches works well to form a handle 15 with a central portion 30 which is easily gripped by a user. Further shown is a gap H1 between the top or upper surface 14 of the body 12, and the furthest point 19 of the arched central portion 30 of the handle 15. A preferred distance of this gap H1 in experimentation which helped to minimize the torque or leverage imparted by the body 12 against the handle 15 during swinging and other exercises, was a gap H1 of between 1.5 to 2 times the diameter W1 of the handle 15. Currently, a gap H1 of between 1-4 inches is preferred to minimize the leverage force caused by the torque of the body 12 twisting the handle 15 during swinging and other uses of the device 10.

As shown, this central portion 30 of the handle 15 is positioned in between the first end 17 and second end 18 of the handle 15 which is permanently engaged to or formed as a unitary structure with the body 12. Both the first end 17 and second end 18 of the handle 15 are formed in a respective reverse curve, from their intersection with the central portion 30, and extend to engagement with the upper surface 14 of the body 12, along a respective end portion reverse curve axis shown as V1 and V2. By reverse curve is meant that each of the two handle ends reverse the direction of the handle at that respective end, and extend back toward the upper surface engagement to the body 12 along a respective handle end axis. A first reverse curve of the first end 17 of the handle 15 curves and extends in reverse from the handle axis 21, along axis V1 and the second reverse curve of the second end 18 of the handle 15 changes direction and also extends to the connection to the body 12 along second reverse axis V2. Currently, the angle of both the V1 and V2 from the flat lower surface 16 of the body 12 or the upper surface 14 if also flat, runs at an angle A, which is between 30 to 50 degrees.

This angled intersection of both the first end 17 and second end 18 with the body 12 imparts force to the body 12 at force vectors running toward a central area of the body 12, such as an area on either side of line H1 shown in FIG. 2, and away from the first side edge 20 and second side edge 22. Such, as noted above has been found to yield a more stable device 10 when used for exercise, especially where the user grips the central portion 30 of the handle 15 to support their body weight thereon.

Also shown in FIG. 2, and preferred, is a total length of the handle 15 between the exterior surfaces 17A and 18A of the respective curved portions 17 and 18, is configured such that the exterior surfaces 17A and 18A of both of the curved portions 17 and 18 closest to a respective linear side edge 20 or 22, does not extend past an imaginary line extending above and parallel to the planar linear first side edge 20 and second side edge 22. This is preferred because in experimentation it was shown that it better kept the outside edges of the curved portions 17 and 18, from striking or otherwise contacting the user during swinging of the device 10 as well as keeping the first side edge 20 and the second side edge 22 from striking the user during use.

As noted, FIG. 3 is a top plan view of the device 10 of FIGS. 1-2, and shows the handle 15 having a handle axis 21 running substantially perpendicular to the linear first side edge 20 and second side edge 22 which run substantially parallel to each other. Also shown are the curved or half circle shaped first central edge 26 running opposite the second central edge 28, both of which extend between the first side edge 20 and second side edge 22.

Figure 4:
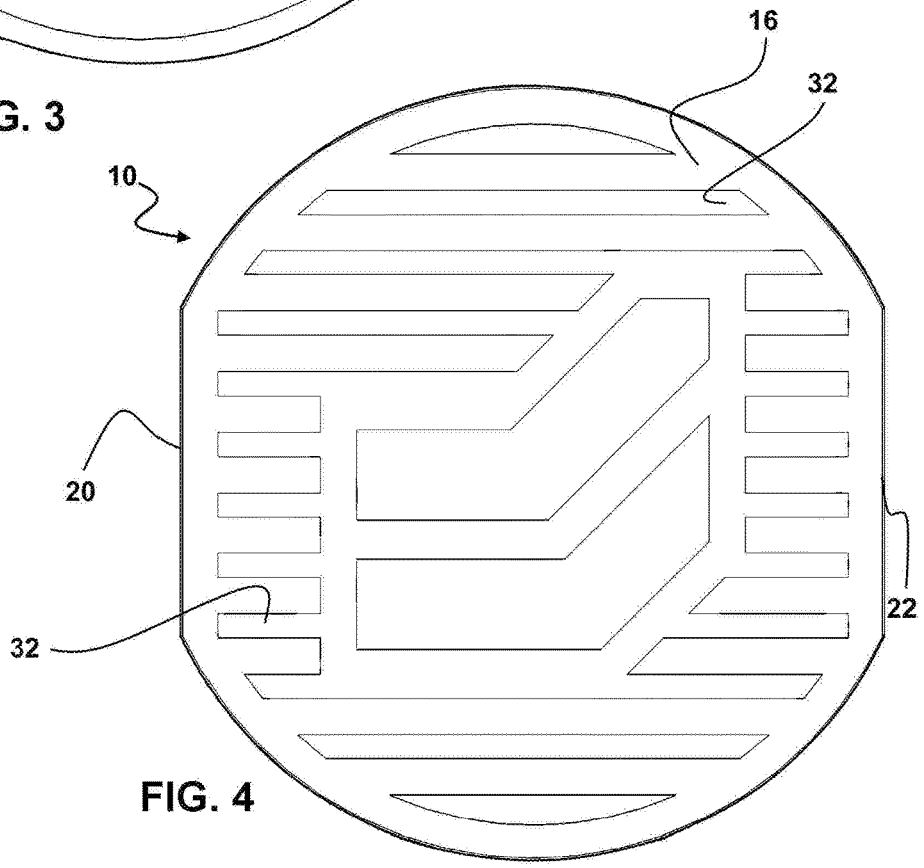
FIG. 4 depicts a view of a bottom surface of the body of the kettlebell device herein.

Shown in FIG. 4 is the lower surface 16 of the body 12. Also shown are the linear first side edge 20 running opposite and substantially parallel to the second side edge 22. Additionally depicted on the lower surface 16, are a plurality of recessed areas 32 formed into the lower surface 16. While the device 10 will perform well without them, it was found during experimentation, that the recessed areas 32 provided better traction for the lower surface 16 when placed on a support surface such as a floor, which minimized or eliminated slipping. This was especially true on a carpeted surface.

Figure 5:
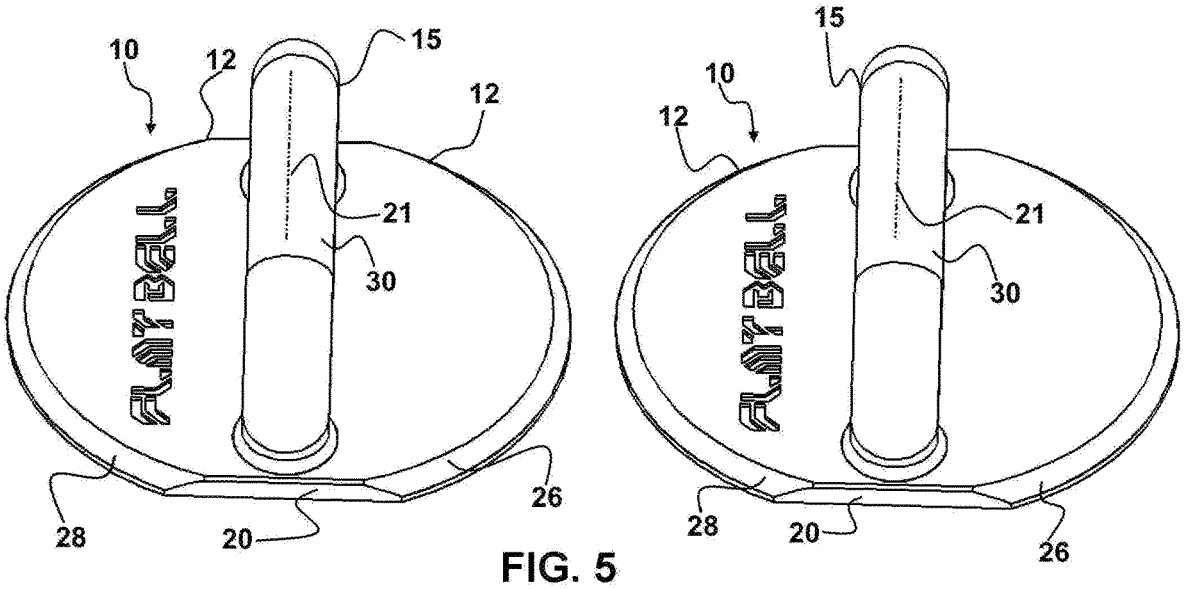
FIG. 5 depicts employment of a pair of kettlebells per the system herein.
Figure 6:
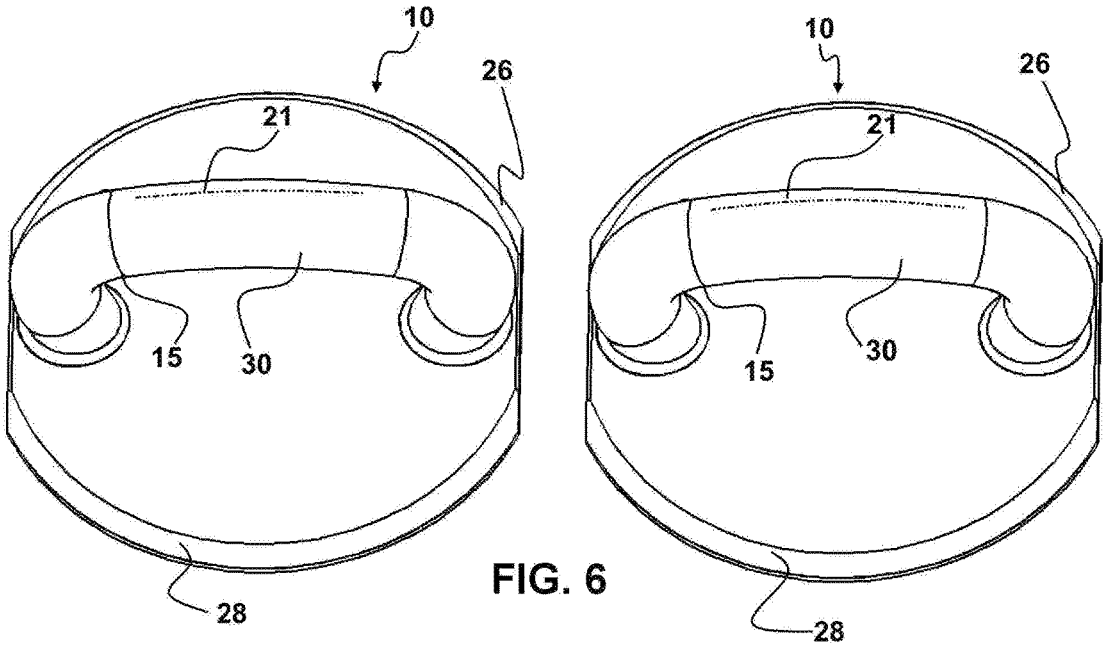
FIG. 6 shows the pair of kettlebells of FIG. 5, rotated to provide a different grip for user support.

Shown in FIGS. 5-6 are depictions of the kettlebell device 10 which may be employed in pairs. As shown, when the lower surface 16 of the body 12 of each pair of devices 10 is located upon a support surface, the device 10 in such pairs may be employed for gripping of both handles 15 thereof by the user. This allows the user to use the stability of the devices 10 and the projecting handles 15, for exercises such as pushups. As shown, the handle axis 21 of both devices 10 in pairs may be placed in parallel as in FIG. 5 or changed to an alignment between the two as in FIG. 6, should the user wish to change the orientation of their hands during gripping of the handles 15.

Figure 7:
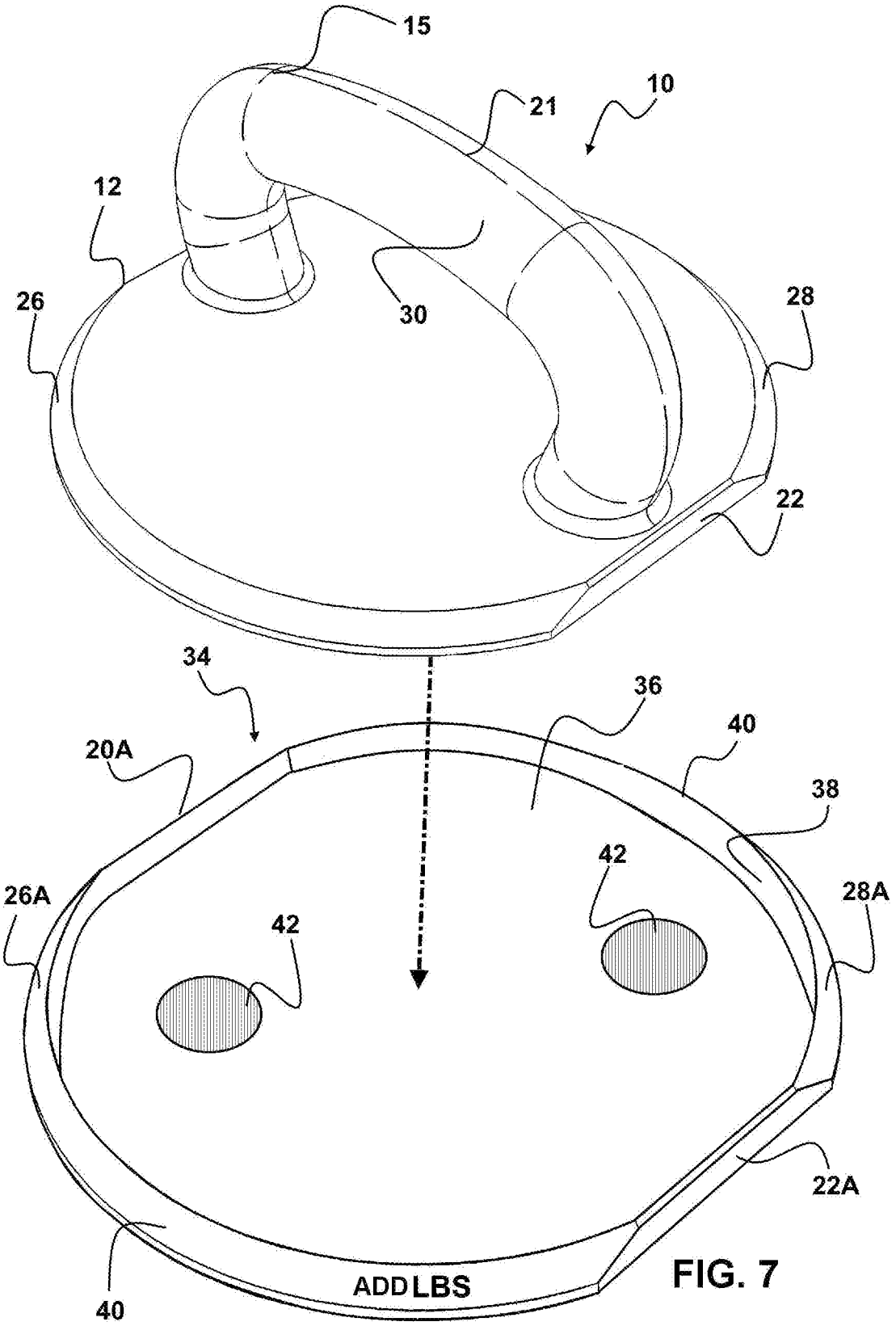
FIG. 7 shows a mode of the kettlebell system herein having removably engageable secondary weights which attach to the body of the kettlebell.

In FIG. 7 is depicted another mode of the kettlebell device 10 herein, wherein a removably engageable secondary weight 34 may be engaged to the body 12 of the kettlebell device 10, to increase the weight for exercise. The kettlebell device 10 weight is provided by the total of the weight of the body 12 and the engaged handle 15 which currently runs between 6-16 pounds. This total weight may be increased, by the weight of the secondary weight 34 which currently is preferred at 5-15 pounds.

The secondary weight 34 preferably is a mirror image shape of the perimeter edge of the body 12, in that the exterior perimeter of the secondary weight 34 includes a first side edge 20A and second side edge 22*a*, and a beveled first central edge 26*a* and second central edge 28*a*. This mirrored shape of the perimeter edge of the secondary weight 34 to that of the body 12, insures that the user has the benefit noted above of the planar first and second side edges as well as beveled central edges.

A removable connection of the secondary weight 34 to the body 12 of the kettlebell device 10 is currently provided by a recess 36 which is formed into the secondary weight 34. The recess 36 has an interior circumference 38 defined by a sidewall 40 surrounding the recess 36. The shape of the interior circumference 38 of the recess 36 is a mirror image which is essentially the same as a shape of the exterior circumference of the body 12 of the device 10. Thus, the circumference of the body 12 defined by the shape and length of the opposing first and second side edges 20 and 22 and the shape and length of the first central edge 26 and second central edge 28, is equal to or essentially the same as that of the interior circumference 38 of the secondary weight 34. Thus, the body 12 of the device 10 may be simply placed within the matching recess 36, where it may be removably held in place by magnets 42. The magnets 42 are shown engaged to the secondary weight 34 but could also be positioned on the body 12 of the kettlebell device 10 and provide a removable fastener between the two.

Figure 8:
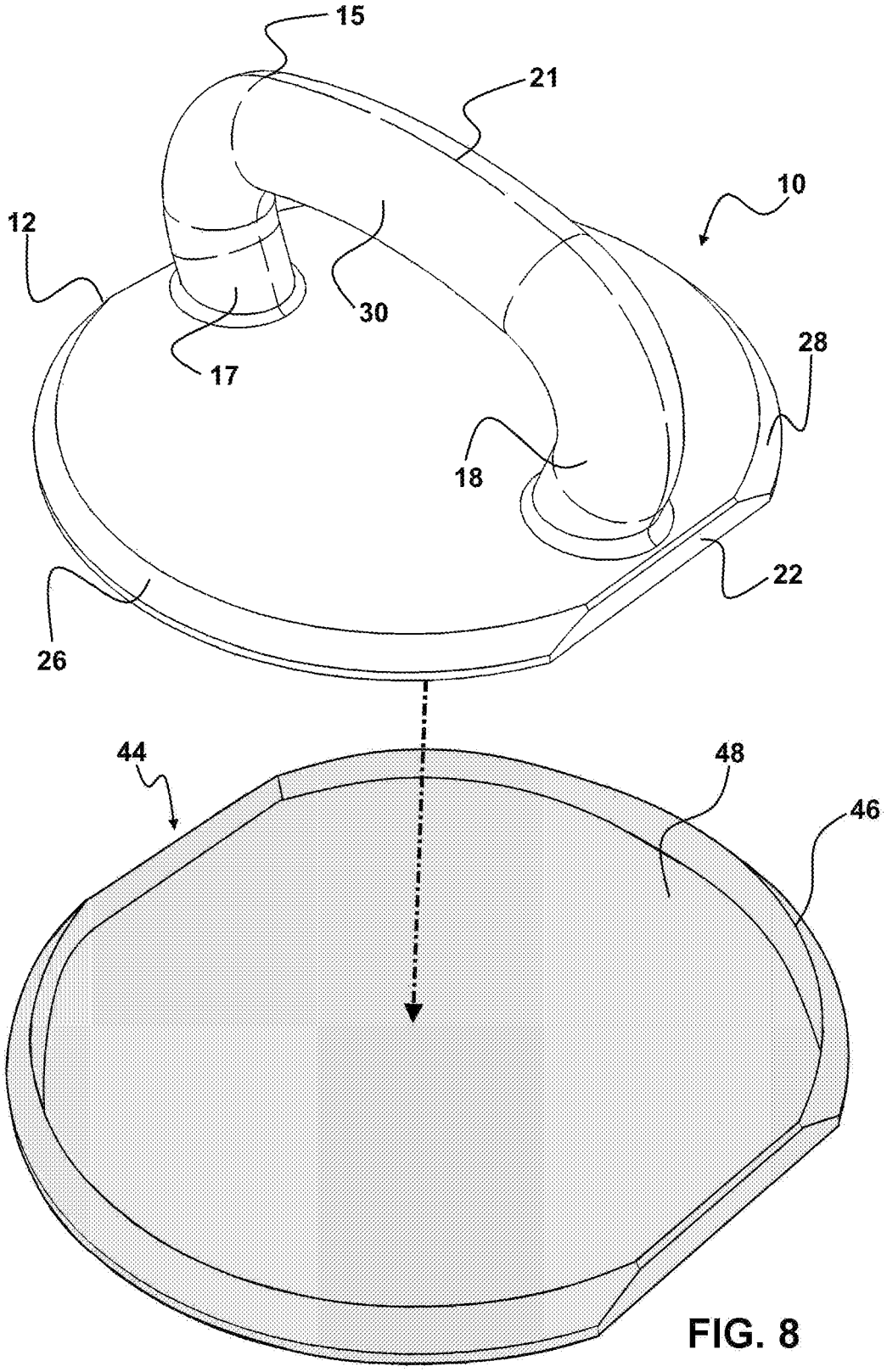
FIG. 8 shows the polymeric covers which removably engage to the body of the kettlebell.
Figure 9:
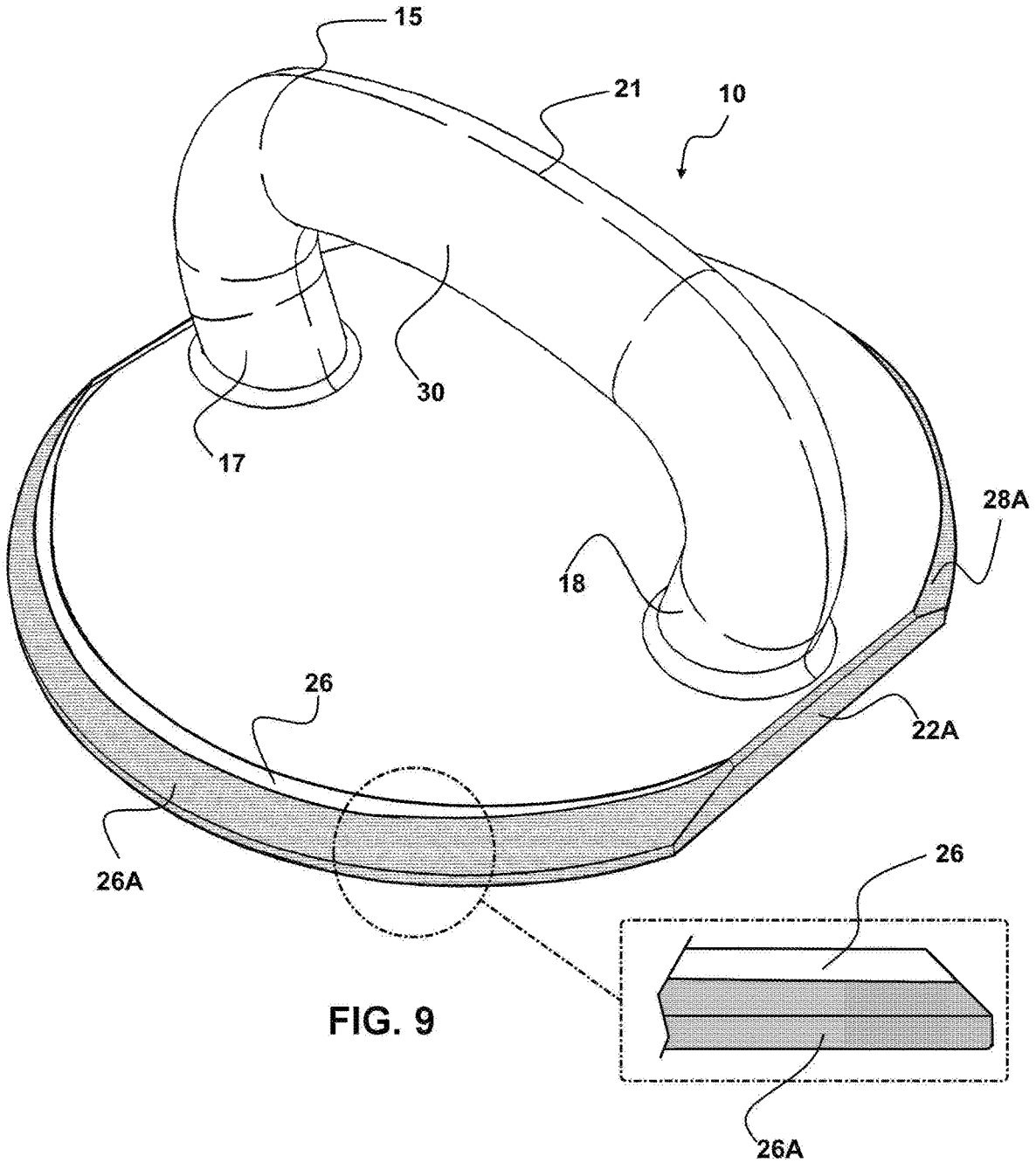
FIG. 9 shows the polymeric cover engaged to the body of the kettlebell of FIG. 8.

FIGS. 8-9 show another preferred mode of the kettlebell device 10 herein, which include a removably engageable polymeric cover 44. Much the same as the above noted secondary weight 34, the removable cover 44 is removably engageable to the body 12 of the kettlebell device 10. Preferably this engagement would be a biased engagement of cover sidewalls 46 which surround and define a shape of the circumference of a cover recess 48. By forming the circumference defined by the sidewalls 46 as a slightly smaller mirror image of the circumference of the body 12, when the body 12 is slid into the cover recess 48, the polymeric material forming the cover sidewall 46 will stretch slightly and compress upon the circumference of the body 12. This will form a biased compressive engagement of the cover sidewall 46 against the circumference of the body 12, and hold the removable cover 44 on the body 12. This cover 44 is desirable where the kettlebell device 10 may be used or placed on a support surface such as a hardwood floor or slick concrete to prevent slipping and to protect the underlying support surface from impact damage from hard contacts with the body 12 of the kettlebell device 10.

While all of the fundamental characteristics and features of the kettlebell exercise device and system having a planar body, have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention.

What is claimed is:

1. A kettlebell apparatus, comprising:

a planar body, said body having a substantially planar upper surface opposite a lower surface;

said lower surface being flat and adapted for positioning on a planar support surface;

a handle, said handle having a first handle end in an engagement with said upper surface of said body and having a second handle end in an engagement to said upper surface of said body, and having a central portion of said handle communicating between said first handle end and said second handle end;

said handle having a handle axis running through said central portion thereof;

said body having a first side edge communicating between said upper surface and said lower surface;

said body having a second side edge communicating between said upper surface and said lower surface, said second side edge positioned opposite said first side edge;

said body having a first central edge extending between said first side edge and said second side edge, said first central side edge communicating between said upper surface and said lower surface;

said body having a second central edge extending between said first side edge and said second side edge, said second central side edge communicating between said upper surface and said lower surface;

said first side edge and said second side edge both being linear and running substantially parallel to each other along a line substantially normal to said handle axis;

said body having a perimeter edge shape defined by said first side edge, said second side edge, said first central edge, and said second central edge;

a secondary weight, said secondary weight having a recess therein;

a recess perimeter edge being shaped the same as said perimeter edge, whereby said body is slidably positionable within said recess, and magnets engaged with said secondary weight, said magnets forming a removable connector of said secondary weight to said body.

2. The kettlebell of claim 1 additionally comprising:

said central portion of said handle shaped in an arch, said arch running between said first handle end and said second handle end;

said central portion of said handle having a diameter sized between 1-2 inches;

said central portion of said handle having a circumferential surface;

a gap running between a furthest point of said circumferential surface of said central portion of said handle from said upper surface of said body, said gap being a distance which is 1-1.5 times said diameter of said central portion of said handle;

said first central edge formed in a first curve, said first curve extending in a direction away from said handle axis; and said second central edge formed in a second curve, said second curve being a mirror image of said first curve and extending away from said handle axis in an opposite direction from said first curve.

3. The kettlebell of claim 1 additionally comprising:

said first central edge formed in a first curve, said first curve extending in a direction away from said handle axis; and said second central edge formed in a second curve, said second curve being a mirror image of said first curve and extending away from said handle axis in an opposite direction from said first curve.

4. The kettlebell of claim 1 additionally comprising:

said first handle end formed in a first reverse curve running between said central portion of said handle and said upper surface of said body;

said first handle end at said engagement thereof to said upper surface of said body running along a first reverse axis;

said second handle formed in a second reverse curve running between said central portion of said handle and said upper surface of said body;

said second handle end at said engagement thereof to said upper surface of said body running along a second reverse axis; and both said first reverse axis and said second reverse axis intersecting said body at an angle between 30-50 degrees.

5. A kettlebell apparatus, comprising:

a planar body, said body having a substantially planar upper surface opposite a lower surface;

said lower surface being flat and adapted for positioning on a planar support surface;

a handle, said handle having a first handle end in an engagement with said upper surface of said body and having a second handle end in an engagement to said upper surface of said body, and having a central portion of said handle communicating between said first handle end and said second handle end;

said handle having a handle axis running through said central portion thereof;

said body having a first side edge communicating between said upper surface and said lower surface;

said body having a second side edge communicating between said upper surface and said lower surface, said second side edge positioned opposite said first side edge;

said body having a first central edge extending between said first side edge and said second side edge, said first central side edge communicating between said upper surface and said lower surface;

said body having a second central edge extending between said first side edge and said second side edge, said second central side edge communicating between said upper surface and said lower surface;

said first side edge and said second side edge both being linear and running substantially parallel to each other along a line substantially normal to said handle axis;

said body having a perimeter edge shape defined by said first side edge, said second side edge, said first central edge, and said second central edge; and a polymeric cover, said polymeric cover having a cover recess therein;

a cover recess perimeter edge being shaped the same as said perimeter edge, whereby said body is slidably positionable to a biased engagement within said recess.

6. The kettlebell of claim 5 additionally comprising:

said first central edge formed in a first curve, said first curve extending in a direction away from said handle axis; and said second central edge formed in a second curve, said second curve being a mirror image of said first curve and extending away from said handle axis in an opposite direction from said first curve.

7. The kettlebell of claim 5 additionally comprising:

said central portion of said handle shaped in an arch, said arch running between said first handle end and said second handle end;

said central portion of said handle having a diameter sized between 1-2 inches;

said central portion of said handle having a circumferential surface;

a gap running between a furthest point of said circumferential surface of said central portion of said handle from said upper surface of said body, said gap being a distance which is 1-1.5 times said diameter of said central portion of said handle;

said first central edge formed in a first curve, said first curve extending in a direction away from said handle axis; and said second central edge formed in a second curve, said second curve being a mirror image of said first curve and extending away from said handle axis in an opposite direction from said first curve.

8. The kettlebell of claim 5 additionally comprising:

said first handle end formed in a first reverse curve running between said central portion of said handle and said upper surface of said body;

said first handle end at said engagement thereof to said upper surface of said body running along a first reverse axis;

said second handle formed in a second reverse curve running between said central portion of said handle and said upper surface of said body;

said second handle end at said engagement thereof to said upper surface of said body running along a second reverse axis; and both said first reverse axis and said second reverse axis intersecting said body at an angle between 30-50 degrees.

* * * * *